US006532969B2

(12) United States Patent
Nuzzo

(10) Patent No.: US 6,532,969 B2
(45) Date of Patent: Mar. 18, 2003

(54) SELF-PEDICURE UNIT INCLUDING CONTOURED FOOT SUPPORT AND INTERNAL STORAGE COMPARTMENTS

(75) Inventor: Robert A. Nuzzo, Barrington, IL (US)

(73) Assignee: Marketing Productions, Inc., Villa Park, IL (US)

( * ) Notice: Subject to any disclaimer, the term of this patent is extended or adjusted under 35 U.S.C. 154(b) by 0 days.

(21) Appl. No.: 09/784,560

(22) Filed: Feb. 15, 2001

(65) Prior Publication Data

US 2002/0108627 A1 Aug. 15, 2002

(51) Int. Cl.[7] ..... A45D 40/18; A45D 29/20; A45D 29/18

(52) U.S. Cl. ..... 132/286; 132/75; 132/73.5

(58) Field of Search ..... 132/286, 75, 73.5, 132/294, 300, 73; 4/574.1, 621, 622; D3/200; 206/577

(56) References Cited

U.S. PATENT DOCUMENTS 1,920,171 A * 8/1933 Gerstner ..... 4/574.1
2,664,585 A * 1/1954 Gaither ..... 219/217
2,957,194 A * 10/1960 Ross ..... 4/574.1
2,991,495 A * 7/1961 Blalack ..... 4/574.1
D205,058 S * 6/1966 Herbert ..... D9/2
D287,075 S * 12/1986 Colin et al. ..... D6/349
4,994,648 A * 2/1991 Gil ..... 219/217
D320,703 S * 10/1991 Burkhart ..... D6/349
5,087,036 A * 2/1992 Cooper ..... 272/96
5,639,143 A * 6/1997 Ackerman ..... 297/180.12
6,115,857 A * 9/2000 Bidegain ..... 4/574.1
6,244,992 B1 * 6/2001 James ..... 482/79

* cited by examiner

*Primary Examiner*—John J. Wilson
*Assistant Examiner*—Robyn Kieu Doan
(74) *Attorney, Agent, or Firm*—McAndrews, Held & Malloy, Ltd.

(57) ABSTRACT

A compact, portable self-pedicure unit for use in performing self-pedicures. The self-pedicure unit includes an adjustable foot support and at least one product storage compartment. The adjustable foot support provides for positioning of the foot at an angle optimal for comfort, support, and pedicure results. The product storage compartment(s) provide the user of the self-pedicure unit with easy access to and retrieval of pedicure related supplies during performance of a self-pedicure. The product storage compartment(s) further provide for storage of pedicure related products when the unit is not in use.

15 Claims, 2 Drawing Sheets

274
274
252
262
254
258
268
278
270
250
204
104
102
276
202
230
256
280
214
264
210
218
260
228
224
206
220
264
200
208
226
216
212
272
222
260

SELF-PEDICURE UNIT INCLUDING CONTOURED FOOT SUPPORT AND INTERNAL STORAGE COMPARTMENTS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a pedicure unit, but more specifically to a compact, portable self-pedicure unit.

A pedicure is a cosmetic treatment of the foot, such as nail trimming, polishing, etc., typically performed on the foot of a second person by a trained pedicurist. A self-pedicure is a pedicure that one person performs on himself or herself. Pedicures are typically performed on a second person, however, because it is typically extremely awkward for a single person to position and maintain the foot in a comfortable position while performing a self-pedicure treatment. However, having a pedicure performed by a trained pedicurist is typically expensive. Therefore, not everyone who desires a pedicure may be able to afford to receive a pedicure from a trained pedicurist. Conversely, performing a self-pedicure is typically not expensive.

Numerous pedicure devices may be observed in the prior art. For example, U.S. Pat. No. 4,075,457 (the '457 patent) issued on Feb. 21, 1978 to Williams is representative of a typical present day two-person pedicure unit. FIG. 1 of the '457 patent discloses a large bench treatment unit 10 of a height that enables a seated person 14 to receive a pedicure from a pedicurist or another person. As shown in FIGS. 1 and 2, the treatment unit 10 includes a flat center tray 33, baths 30, and storage compartments 26. The baths 30 are located to the right and left of the center tray 10 and the storage compartments 26 are located at the right and left ends of the bench treatment unit 10. To receive a pedicure treatment, the seated person may soak the foot 13 in one of the baths 30 and then place the foot on the center tray 10. The bench treatment unit 10 is designed to allow a second person such as a pedicurist to sit across from and perform a pedicure on the seated person 14. The bench treatment unit 10 is not designed to allow the seated person 14 to perform a self-pedicure.

With regard to self-pedicure units, several systems may be found in the prior art. For example, U.S. Pat. No. 4,294,268 (the '268 patent) issued on Oct. 31, 1981 to Kitrell discloses a self-pedicure unit 10. FIGS. 1 and 2 of the '268 patent illustrates a self-pedicure unit 10 including supports 12, 14 and a foot plate 16. A support extends from the foot plate 16 downward to the floor. A second support 14 extends from the first support 12 to a toilet bowl 90. In operation the supports 12, 14 support the foot plate 16 such that the person using the self-pedicure unit 10 may sit on the toilet lid 94, place their foot on the foot plate 16, and perform a self-pedicure. Although the '268 patent teaches a self-pedicure unit, it suffers from several drawbacks. For example, the self-pedicure unit of the '268 patent allows a foot to slip off of the positioning surface, the operator does not have ready accessibility to all needed pedicure supplies, and the foot surface may be awkward for some users.

U.S. Pat. No. 5,501,682 (the '682 patent) also illustrates a self-pedicure unit S. The self-pedicure unit S of the '682 patent includes a foot support 10 that incorporates a vibrating means 30, blower 42, and a lamp 56. The vibrating means, blower, and lamp aide in the performing of a pedicure or a self-pedicure. Although the '682 patent teaches a self-pedicure unit, it suffers from several drawbacks. For example, the self-pedicure unit of the '682 patent does not provide the operator with ready accessibility to all needed pedicure supplies and the foot surface may be awkward for some users.

Thus a need has long been felt for a self-pedicure unit including the desirable factors of (1) ready accessibility to all needed pedicure supplies, (2) comfortable positioning of the foot, (3) prevention of slipping of the foot during treatment, and (4) ease of performing a self-pedicure treatment. Such a self-pedicure unit is very desirable by persons who desire a pedicure but can not afford a pedicure by a pedicurist.

BRIEF SUMMARY OF THE INVENTION

The preferred embodiment of the present invention provides a self-pedicure unit including an adjustable foot support and internal storage compartments. The adjustable foot support of the self-pedicure unit provides a surface that supports the foot during a self-pedicure treatment. In addition, the angle of the adjustable foot support may be changed such that the foot is supported at an angle comfortable to the person using the unit. The internal storage compartments of the self-pedicure unit provide for of the various pedicure supplies so that the procedure supplies are easily accessible to the person using the unit for performing the self-pedicure. Additionally, the internal storage compartments provide for storage of pedicure supplies within the unit when not being used.

DETAILED DESCRIPTION OF THE PREFERRED EMBODIMENT

Figure 1:
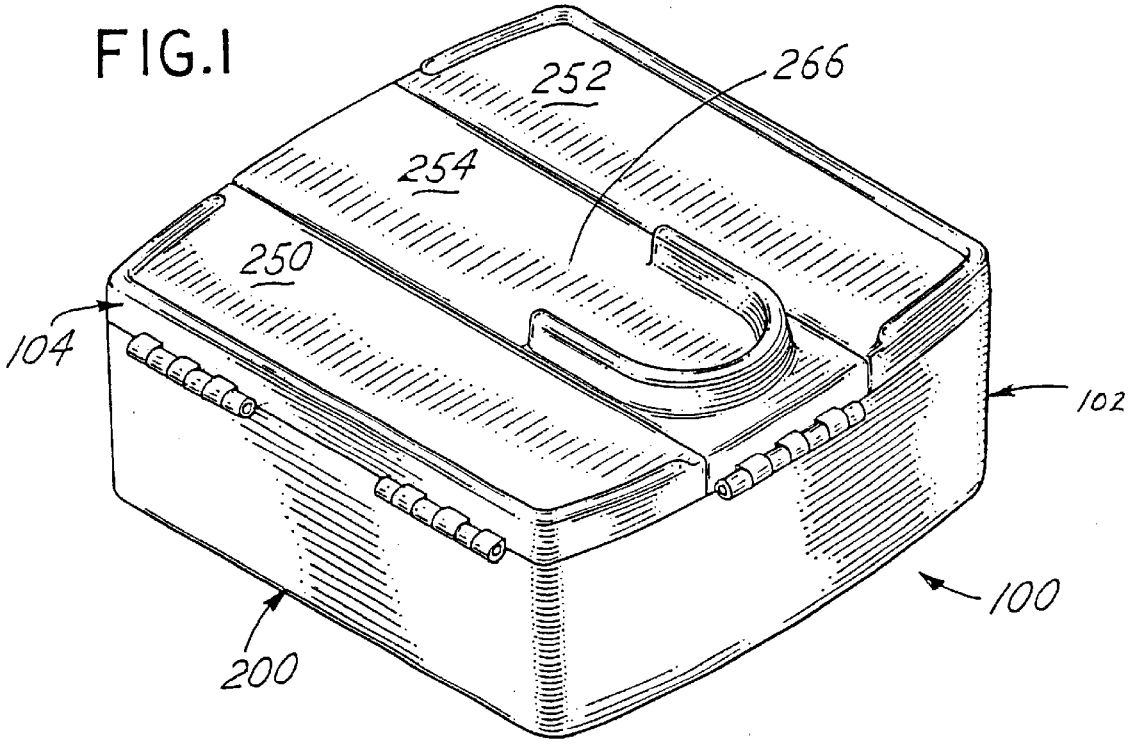
FIG. 1 illustrates a self-pedicure unit according to the preferred embodiment of the present invention.

FIG. 1 illustrates a self-pedicure unit 100 according to the preferred embodiment of the present invention. The self-pedicure unit 100 includes a base module 102 and a lid module 104. The lid module 104 is positioned on the base module 102 and connected to the base module 102. The self-pedicure unit 100 is sized such that the self-pedicure unit 100 is easily portable and is capable of being utilized in almost any setting. Preferably, the self-pedicure unit 100 is approximately 13 inches wide by 13 inches long by 6 inches high. The body module 102 and the lid module 104 are preferably constructed of a rigid material such as a plastic by injection molding. Alternatively, the self-pedicure unit may be constructed by affixing semi-rigid panels over a rigid frame.

Figure 2:
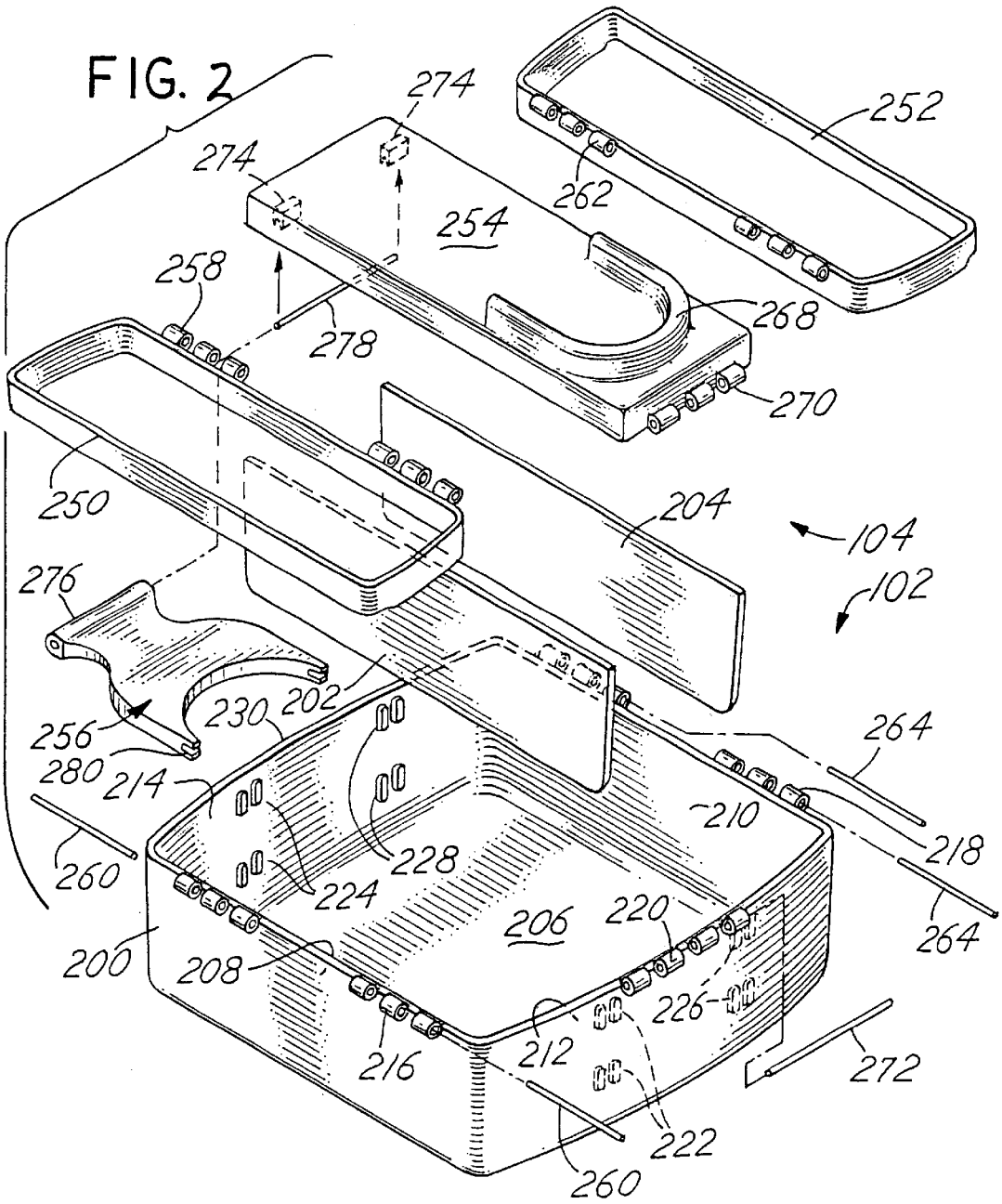
FIG. 2 illustrates an exploded view of the self-pedicure unit of FIG. 1 according to a preferred embodiment of the present invention.

FIG. 2 illustrates an exploded view of the self-pedicure unit 100 of FIG. 1 according to a preferred embodiment of the present invention. As shown in FIG. 1 above, the self-pedicure unit 100 includes a base module 102 and a lid module 104.

Base module 102 includes a self-pedicure compartment base 200, left divider 202, and right divider 204. Self-pedicure compartment base 200 includes a bottom 206, left wall 208, right wall 210, front wall 212, rear wall 214, left wall hinges 216, right wall hinges 218, front wall hinge 220, front left divider positioning locks 222, rear left divider positioning locks 224, front right divider positioning locks 226, rear right divider positioning locks 228, and a support arm fixing point 230.

The left divider 202 is connected to the self-pedicure compartment base 200 by the front left divider positioning locks 222 and rear left divider positioning locks 224. The right divider 204 is connected to self-pedicure compartment base 200 by the front right divider positioning locks 226 and rear right divider positioning locks 228.

The lid module 104 includes a left lid 250, right lid 252, center contoured lid 254, and contoured lid support arm 256. The left lid 250 includes left lid hinges 258 and left lid hinge pins 260. The right lid 252 includes right lid hinges 262 and right lid hinge pins 264. The center contoured lid includes a foot positioning area 266, heel stop 268, center contoured lid hinge 270, center contoured lid hinge pin 272, and center contoured lid support arm attachment clips 274. The support arm 256 includes a support arm hinge 276, support arm hinge pin 278, and support arm clips 280.

The left lid 250 is connected to the left wall 208 by the left wall hinges 216, left lid hinges 258, and left lid hinge pins 260. The right lid 252 is connected to the right wall by the right wall hinges 218, right lid hinges 262, and right lid hinge pins 264. The center contoured lid 254 is connected to the front wall 212 by the front wall hinge 220, center contoured lid hinge 270, and center contoured lid hinge pin 272. The support arm 256 is connected to the center contoured lid 254 by the center contoured lid support arm attachment clips 274, support arm hinge 276, and support arm hinge pin 278.

Figure 3:
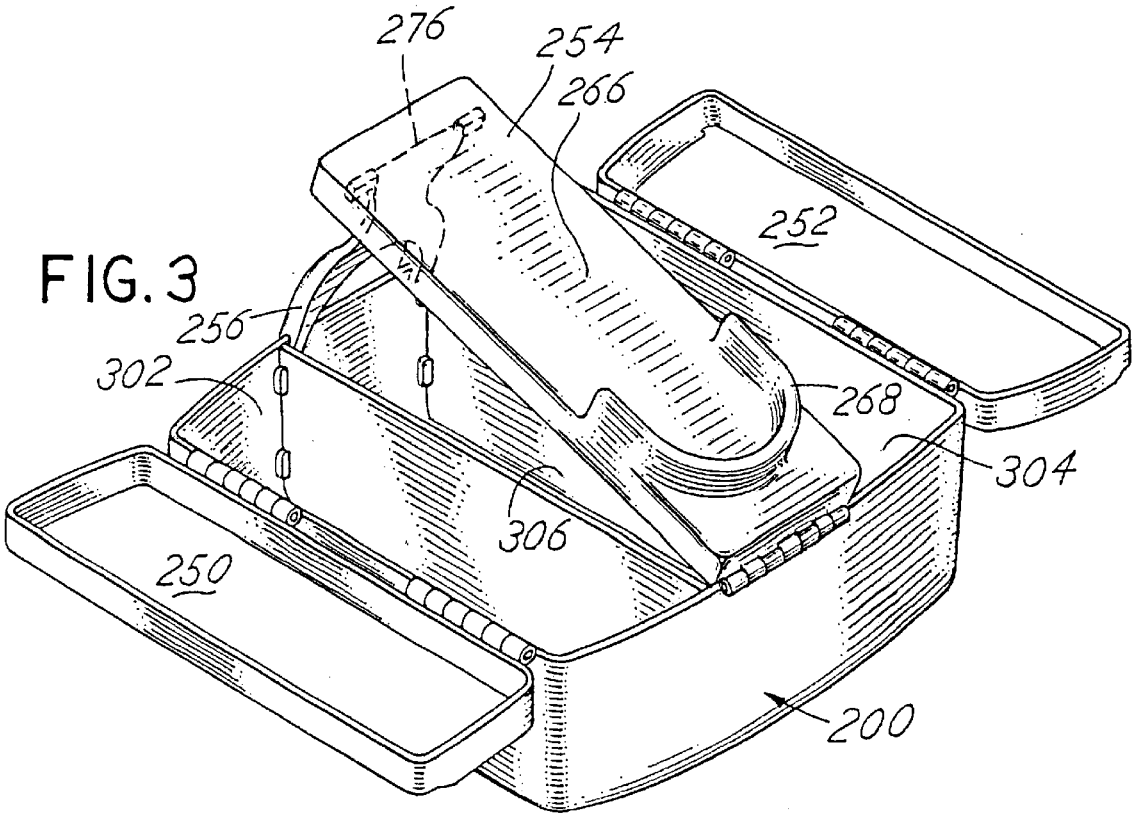
FIG. 3 illustrates a vertical slice of the base module of FIG. 1 according to a preferred embodiment of the present invention.

When assembled the self-pedicure unit of the present invention includes several internal compartments. FIG. 3 illustrates a horizontal slice of the base module 102 of FIG. 1 according to a preferred embodiment of the present invention to illustrate the storage compartments of the self-pedicure unit. As shown in FIG. 2 above, the base module 102 includes the left divider 202, right divider 204, bottom 206, left wall 208, right wall 210, front wall 212, and rear wall 214. A left internal storage compartment 302 is formed by the combination of the left divider 202, bottom 206, left wall 208, front wall 212, and rear wall 214. A right internal storage compartment 304 is formed by the combination of the right divider 204, bottom 206, right wall 210, front wall 212, and rear wall 214. A center internal storage compartment 306 is formed by the combination of the left divider 202, right divider 204, bottom 206, front wall 212, and rear wall 214. The left internal storage compartment 302 is fully enclosed by the addition of the left lid 250. The right internal storage compartment 304 is fully enclosed by the addition of the right lid 252. The center internal storage compartment 306 is fully enclosed by the addition of the center contoured lid 254.

In operation, a person desiring to use the self-pedicure unit 100 may raise the center contoured lid 254 and fix the position of the center contoured lid 254 by securing the support arm 256 on the rear wall 214 by attaching the support arm clips 280 onto the support arm fixing point 230. The person may then place a foot (not shown) on the center contoured lid 254 such that the heel of the foot is against the heel stop 268. The person then may then retrieve pedicure-related products from one or more of the various storage compartments 302, 304, 306 and perform a self-pedicure. For example, the person may open left lid 250 to expose the left internal storage compartment 302 and retrieve a pedicure-related product such a pair of scissors or a file.

Once the self-pedicure is complete, the self-pedicure unit may be easily configured for storage. That is, when the self-pedicure is complete, the person may return the pedicure related products to the storage compartments 302, 304, 306, shut the left lid 302, shut the right lid 304, disconnect the support arm clips 280 from the support arm fixing point 230, fold the support arm 256 under the center contoured lid 254, and shut the center contoured lid 254. The self-pedicure unit as configured for storage may be easily and conveniently stored anywhere until needed again.

Although FIGS. 1–3 illustrate the preferred embodiment of the self-pedicure unit 100, several alternate embodiments may also be used. For example, instead of using the hinges 216, 218, 258, 262, the lids 250, 252 may snap onto the walls of self-pedicure compartment base 200. The hinges 216, 218, 258, 262 may also be replaced by other mechanical fasteners such as flexible plastic joining. Also, in the alternative, the divider positioning locks 222, 224, 226, 228 may be replaced by other mechanical fasteners such as screws or adhesive, for example. Also, the center contoured lid 254 may be constructed as either a flat plate, a flat plate with a non-slip surface, and/or contoured to the shape of a foot. Additionally, the adjustability of the support arm 256 may be increased by including additional positioning slots, located on the interior of the rear wall 214, or by including a sliding positioner on the bottom side of the center contoured lid 254.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications and incorporate those features which come within the spirit and scope of the invention.

What is claimed is:

1. A portable unit for use in performing a self-pedicure comprising:

a removable divider, said removable divider having a plurality of position locks;

an angularly adjustable foot support; and a product storage compartment attached to said angularly adjustable foot support, wherein said product storage compartment has a plurality of lids, wherein said plurality of lids includes a left lid, a right lid, and a contoured lid, wherein said left lid and said right lid are attached to said product storage compartment with hinges, and wherein said contoured lid includes a fool position area, a heel stop, a center contoured lid hinge, a centered contoured lid hinge pin, and a center contoured lid support arm attachment clip.

2. The portable self-pedicure unit of claim 1 further including a cover covering said product storage compartment.

3. The portable self-pedicure unit of claim 1 further including additional product storage compartments.

4. The portable self-pedicure unit of claim 3 further including a plurality of covers covering said product storage compartments.

5. The portable self-pedicure unit of claim 3 wherein said adjustable foot support forms a lid panel over at least one product storage compartment.

6. The portable self-pedicure unit of claim 1 wherein said adjustable foot support includes a heel stop.

7. The portable self-pedicure unit of claim 1 wherein said foot support includes a support arm to allow for positioning of said foot support at an angle.

8. The portable self-pedicure unit of claim 7 wherein said self-pedicure compartment base includes support arm positioning slots for positioning the support arm to support said foot support at any one of a plurality of angles.

9. The portable self-pedicure unit of claim 1 wherein said product storage compartments case includes one or more internal dividing elements.

10. The portable self-pedicure unit of claim 9 wherein said dividing elements are capable of being inserted in various locations.

11. A method for performing a self-pedicure, said method including the step of:

performing a self-pedicure upon a foot positioned on an adjustable foot support, said foot support connected to a base having at least one product storage compartment, wherein said product storage compartment has a plurality of lids, wherein said plurality of lids includes a left lid, a right lid, and a contoured lid, wherein said left lid and said right lid are attached to said product storage compartment with hinges, and wherein said contoured lid includes a foot position area, a heel stop, a center contoured lid hinge, a centered contoured lid hinge pin, and a center contoured lid support arm attachment clip, and wherein said base includes a removable divider, said removable divider having a plurality of position locks.

12. The method of claim 11 further including the step of adjusting the angle of said adjustable foot support.

13. The method of claim 11 further including the step of positioning said foot against a heel stop.

14. The method of claim 11 further including the step of retrieving pedicure-related products from said product storage compartment.

15. A portable unit for use in performing a self-pedicure comprising:

a removable divider, said removable divider having a plurality of position locks;

an adjustable foot support having a raised heel support; and a product storage compartment attached to said adjustable foot support, wherein said product storage compartment has a plurality of lids, wherein said plurality of lids includes a left lid, a right lid, and a contoured lid, wherein said left lid and said right lid are attached to said product storage compartment with hinges, and wherein said contoured lid includes a foot position area, a heel stop, a center contoured lid hinge, a centered contoured lid hinge pin, and a center contoured lid support arm attachment clip.

* * * * *